US007863534B2

(12) United States Patent
Narayanasamy et al.

(10) Patent No.: US 7,863,534 B2
(45) Date of Patent: Jan. 4, 2011

(54) SPRING DISCHARGE MECHANISM FOR CIRCUIT BREAKER

(75) Inventors: Soundararajan Narayanasamy, Hyderabad (IN); Janakiraman Narayanan, Andra Pradesh (IN); Partha Sarathy Doddapadam Srinivasa Raghavachar, Karnataka (IN); Triplicane Gopikrishnan Babu, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 301 days.

(21) Appl. No.: 12/103,075

(22) Filed: Apr. 15, 2008

(65) Prior Publication Data

US 2009/0255788 A1 Oct. 15, 2009

(51) Int. Cl.
*H01H 5/00* (2006.01)

(52) U.S. Cl. ..... 200/400; 200/401

(58) Field of Classification Search ..... 200/400, 200/401

See application file for complete search history.

(56) References Cited

U.S. PATENT DOCUMENTS

| | | | |
|---|---|---|---|
| 4,743,715 | A | 5/1988 | Gerbert-Gaillard et al. |
| 4,761,521 | A | 8/1988 | Beck et al. |
| 4,761,524 | A | 8/1988 | Golowash |
| 4,884,047 | A | 11/1989 | Baginski et al. |
| 4,940,903 | A | 7/1990 | Brown, Jr. et al. |
| 4,950,848 | A | 8/1990 | Maier et al. |
| 5,036,427 | A | 7/1991 | Krom et al. |
| 5,059,753 | A | 10/1991 | Hamm |
| 5,151,674 | A | 9/1992 | Flohr |
| 5,200,585 | A | 4/1993 | Davies et al. |
| 5,278,722 | A | 1/1994 | Peruso |
| 5,280,258 | A | 1/1994 | Opperthauser |
| 5,309,317 | A | 5/1994 | Ishikawa |
| 5,334,808 | A | 8/1994 | Bur et al. |
| 5,408,062 | A | 4/1995 | Agnatovech |
| 5,584,383 | A | 12/1996 | Matsuo et al. |
| 5,687,835 | A | 11/1997 | Schuler et al. |
| 5,747,766 | A | 5/1998 | Waino et al. |
| 5,883,351 | A | 3/1999 | Castonguay et al. |
| 5,938,008 | A | 8/1999 | Wehrli, III et al. |
| 5,955,716 | A | 9/1999 | Thuries et al. |
| 6,031,192 | A | 2/2000 | Liebetruth |

(Continued)

FOREIGN PATENT DOCUMENTS

EP 1178509 A2 6/1992

(Continued)

*Primary Examiner*—Renee Luebke
*Assistant Examiner*—Lisa Klaus
(74) *Attorney, Agent, or Firm*—Global Patent Operation

(57) ABSTRACT

A spring discharge mechanism for a circuit breaker is provided. The mechanism includes two linkages for crashing or discharging the circuit breaker compression springs to allow the circuit breaker to be used in either fixed breaker installation or in an installation having a drawout mechanism. The secondary mechanism includes a manual activation linkage that couples with an interface plate. The interface plate is coupled to an opening latch shaft and a closing latch shaft that cooperates to discharge the circuit breaker compression springs. An interface lever is also coupled to the interface plate. The interface lever includes a roller that interacts with a pivoting cam lever coupled to a drawout mechanism. The cam lever interacts with the roller causing the interface lever to rotate the interface plate, the opening latch shaft and the closing latch shaft.

20 Claims, 8 Drawing Sheets

U.S. PATENT DOCUMENTS

| | | | | |
|---|---|---|---|---|
| 6,054,661 | A | 4/2000 | Castonguay et al. | |
| 6,072,136 | A | 6/2000 | Wehrli, III et al. | |
| 6,087,610 | A | 7/2000 | Castonguay et al. | |
| 6,160,234 | A | 12/2000 | Wehrli, III et al. | |
| 6,177,641 | B1 | 1/2001 | Morel et al. | |
| 6,403,902 | B1 | 6/2002 | Castonguay et al. | |
| 6,642,463 | B1 | 11/2003 | Turner | |
| 6,759,617 | B2 | 7/2004 | Yoon | |
| 6,870,451 | B1 | 3/2005 | Inoue | |
| 7,470,870 | B2 * | 12/2008 | Schmidt et al. | 200/400 |
| 2002/0158732 | A1 | 10/2002 | Castonguay et al. | |
| 2003/0119344 | A1 | 6/2003 | Byron et al. | |
| 2004/0095047 | A1 | 5/2004 | Salice | |
| 2004/0150495 | A1 * | 8/2004 | Lias et al. | 335/2 |
| 2006/0044729 | A1 | 3/2006 | Domejean et al. | |
| 2008/0047812 | A1 * | 2/2008 | Schaltenbrand et al. | 200/401 |

FOREIGN PATENT DOCUMENTS

| | | | |
|---|---|---|---|
| EP | 855729 | B1 | 3/2001 |
| JP | 4200209 | A | 7/1992 |
| JP | 4200210 | A | 7/1992 |
| JP | 4364311 | A | 12/1992 |
| JP | 6052760 | A | 2/1994 |
| JP | 7245045 | A | 9/1995 |
| JP | 7274324 | A | 10/1995 |
| JP | 9245575 | A | 9/1997 |
| JP | 11329198 | A | 11/1999 |
| JP | 11040013 | A | 12/1999 |
| JP | 2000285770 | A | 10/2000 |
| JP | 2006086066 | A | 3/2006 |
| WO | WO9718569 | A1 | 5/1997 |
| WO | WO2006012717 | A2 | 2/2006 |

* cited by examiner

SPRING DISCHARGE MECHANISM FOR CIRCUIT BREAKER

BACKGROUND OF THE INVENTION

The subject matter disclosed herein relates to a mechanism for a circuit breaker. In particular, the subject matter disclosed herein relates to a mechanism that discharges the energy from the compression springs of a circuit breaker prior to being removed from service.

Air circuit breakers are commonly used in electrical distribution systems. A typical air circuit breaker comprises an assembly of components for connecting an electrical power source to a consumer of electrical power called a load. The electric circuit the circuit breaker is connected to is referred to herein as the protected electric circuit. The components are referred tows a main contact assembly. In this assembly, a main contact is typically either opened, interrupting a path for power to travel from the source to the load, or closed, providing a path for power to travel from the source to the load. In a particular type of circuit breaker, referred to as an air circuit breaker, the force necessary to open or close the main contact assembly is provided by an arrangement of compression springs. When the compression springs discharge, they exert a force that provides the energy needed to open or close the main contacts. Compression springs that provide a force to close the main contacts are often called closing springs. Compression springs that provide a force to open the main contacts are often referred to as contact springs.

The air circuit breakers may be installed in several different configurations. The simplest method is typically referred to as a "fixed breaker" where the installer mounts the air circuit breaker and utilizes hardware, such as bolts for example, to couple the air circuit breaker to the source and load electrical conduits. In this instance, when maintenance or repair is required, the hardware coupling the breaker must be removed before the maintenance or repairs can be performed.

Alternatively, the air circuit breaker may be mounted within a mechanism referred to as a drawout. A drawout is a device well known in the art that holds and carries the air circuit breaker into and out of contact with electrical connections for the source and load. To remove the air circuit breaker from service, the drawout automatically disconnects the circuit breaker from the electrical circuit and moves it into a position for servicing.

With either type of installation, it is desirable to disconnect the circuit breaker from the protected electrical circuit and to discharge the energy in the compression springs prior to initiating the service work.

While existing circuit breakers are suitable for their intended purposes, there still remains a need for improvements particularly regarding the operation of the circuit breaker and the discharging of the circuit breaker compression springs to allow the servicing of the circuit breaker in a variety of applications.

SUMMARY OF THE INVENTION

A method of operating a circuit breaker is provided. The method includes the step of rotating an interface plate from a first position to a second position. An opening latch shaft is rotated from a third position to a fourth position with the interface plate. A set of contacts is opened when the opening latch shaft is in the fourth position. The interface plate is further rotated from the second position to a fifth position. A closing latch shaft is rotated from a sixth position to a seventh position when the interface plate rotates from the second position to the fifth position while keeping the opening shaft in forth position. The energy stored in compression springs is discharged when said closing latch shaft rotates from said sixth position to said seventh position.

A method of operating a circuit breaker drawout is also provided. The method includes biasing a cam lever first end into contact with a circuit breaker housing bottom surface. The housing is moved from a first position in contact with an electrical load to a second position. A second end of the cam lever contacts a roller when the housing reaches the second position. An interface lever slides from a third position to a fourth position in response to the cam lever second end contacting the roller. An interface plate is rotated from a fifth position to a sixth position in response to the interface lever moving from the third position to the fourth position. An opening latch shaft rotates when the interface plate rotates from the fifth position to the sixth position. The interface plate rotates from a sixth position to a seventh position. A closing latch shaft rotates in response to the rotation of the interface plate from the sixth position to the seventh position while keeping the opening latch shaft in rotated position.

A circuit breaker is also provided having a contact structure movable between a closed and an open position. A compression spring is operable between a charged and a discharged position and operably coupled to the contact structure. An opening latch shaft is operably coupled to the contact structure. A closing latch shaft is operably coupled to the compression spring. The circuit breaker includes a first mechanism having an interface plate pivotable between a first position and a third position via an intermediate second position. The interface plate is operably coupled to rotate the opening latch shaft and the closing latch shaft in a manner when said interface plate is moved between first and said intermediate second position will rotate opening latch shaft and also when said interface plate is moved between intermediate second position to third position will rotate said closing latch shaft. An interface lever provided that is slidable between a fourth position and a fifth position. The interface lever has a first end operably coupled to rotate the interface plate.

BRIEF DESCRIPTION OF THE DRAWINGS

Referring now to the drawings, which are meant to be exemplary and not limiting, and wherein like elements are numbered alike.

DETAILED DESCRIPTION

Figure 1:
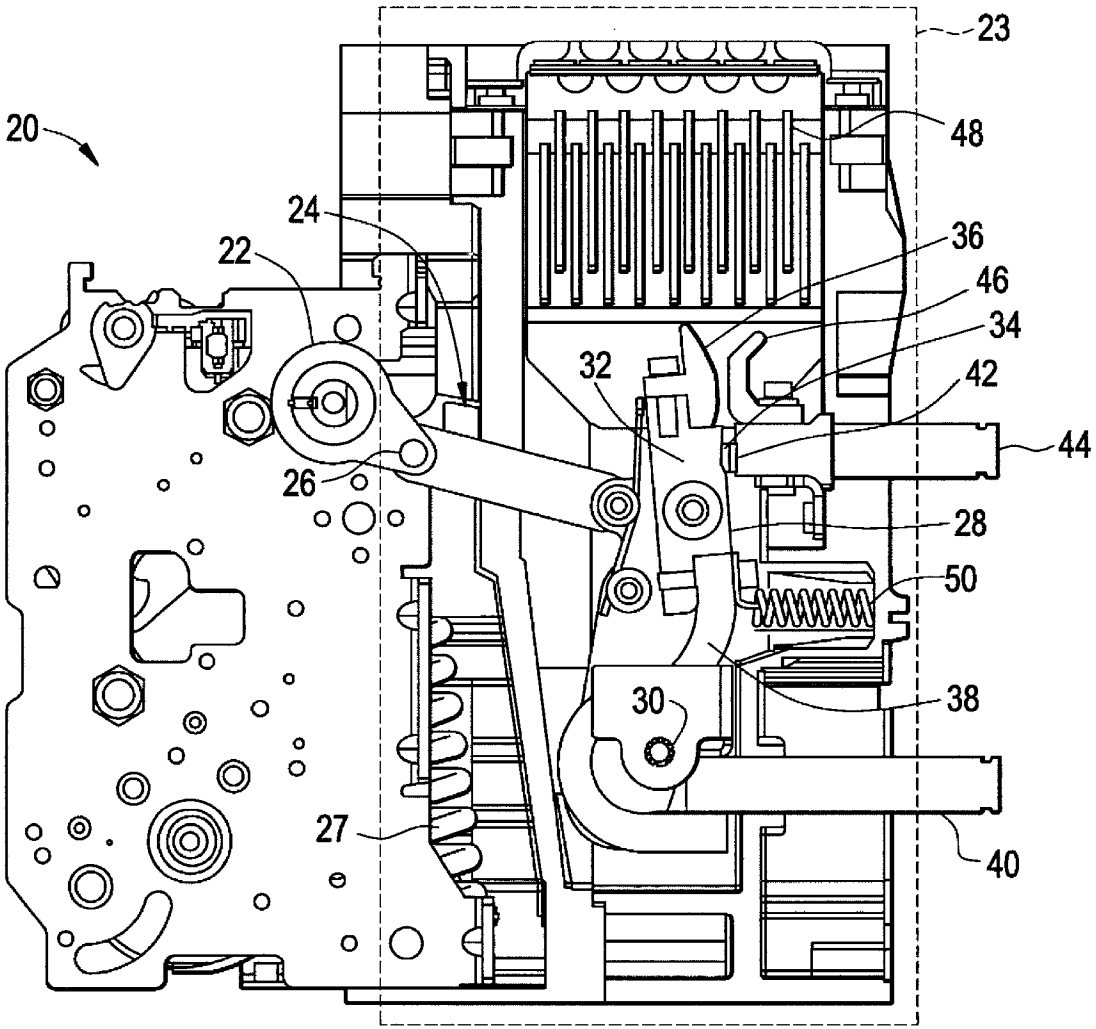
FIG. 1 is a side plan view illustration of a circuit breaker in the closed position in accordance with the exemplary embodiment.

FIG. 1 illustrates a circuit breaker 20 in the closed position. The circuit breaker 20 includes a main mechanism (not shown) that is coupled to a lay shaft assembly 22 within a housing 23. The lay shaft assembly 22 rotates in response to the main mechanism being moved between an on and off position. The lay shaft assembly is coupled to a contact arm coupler 24 through a pin 26. The contact arm coupler 24 as illustrated in FIG. 1 is in a closed position and transfers the energy from the main mechanism compression springs (closing springs) 27 that is necessary to close a contact arm assembly 28. The contact arm assembly 28 is mounted in the circuit breaker 20 to pivot about a pin 30 to move between a closed and open position.

It should be appreciated that the contact arm assembly 28 is illustrated in the exemplary embodiment as a single component. However, the contact arm 32 may be comprised of multiple contact arms each coupled to the contact arm coupler 24. Further, the exemplary embodiment illustrates the circuit breaker 20 has a single contact arm or what is commonly referred to as a "pole." Each pole of a circuit breaker carries electrical current for a single electrical phase. In a "multi-pole" circuit breaker the circuit breaker will have several poles, typically three or four, each carrying a different phase of electricity through the circuit breaker 20. Each of the poles is individually connected to the lay shaft assembly 22 through a separate contact arm coupler 24.

The contact arm assembly 28 includes an arm 32 having a movable main contact 34 and a moveable arcing contact 36 mounted to one end. It will be understood that the movable main contact 34 will mate with a stationary main contact 42, and, the moveable arcing contact 36 will mate with a stationary arcing contact 46. A flexible, electrically conductive strap 38, made from braided copper cable for example, is attached to the opposite end. The strap 38 electrically couples the contact arm 32 to a conductor 40 that allows electrical current to flow through the circuit breaker 20. The electrical current flows through the contact arm assembly 32 and exits via movable main contact 34 and into the protected electric circuit. The current then passes through stationary main contact 42 and into conductor 44 where it is transmitted to the protected electric circuit and load. It will be understood that an arc chute 48 may also be provided to direct the flow of gasses during arcing.

Figure 2:
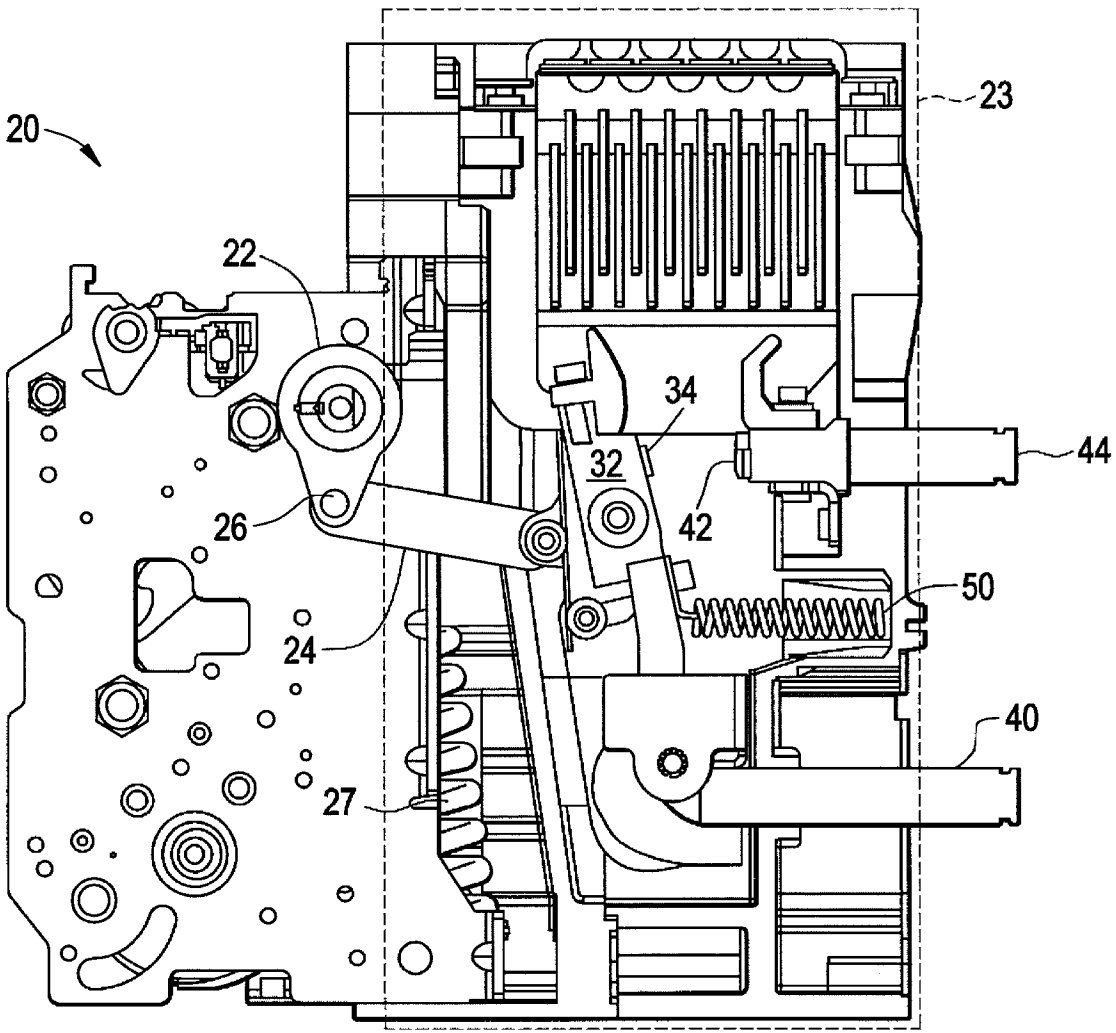
FIG. 2 is a side plan view illustration of the circuit breaker of FIG. 1 in the open position.

During normal operation of the circuit breaker 20, the operator may desire to remove electrical power from a circuit. To accomplish this, the main mechanism is activated, by a handle for example, causing the lay shaft assembly 22 to rotate to an open position as illustrated in FIG. 2. The rotational movement of the lay shaft assembly 22 is translated into motion of the contact arm coupler 24 causing the contact arm assembly 28 to rotate about pivot 30. This rotation by the contact arm assembly 28 results in the movable main contact 34 separating from the stationary main contact 42 and the halting of electrical current flow through the protected electrical circuit. To re-initiate flow of electrical power to the protected electrical circuit, the operator reverses the main mechanism, by moving a handle for example, causing the lay shaft assembly 22 to rotate back to the position illustrated in FIG. 1.

Figure 3:
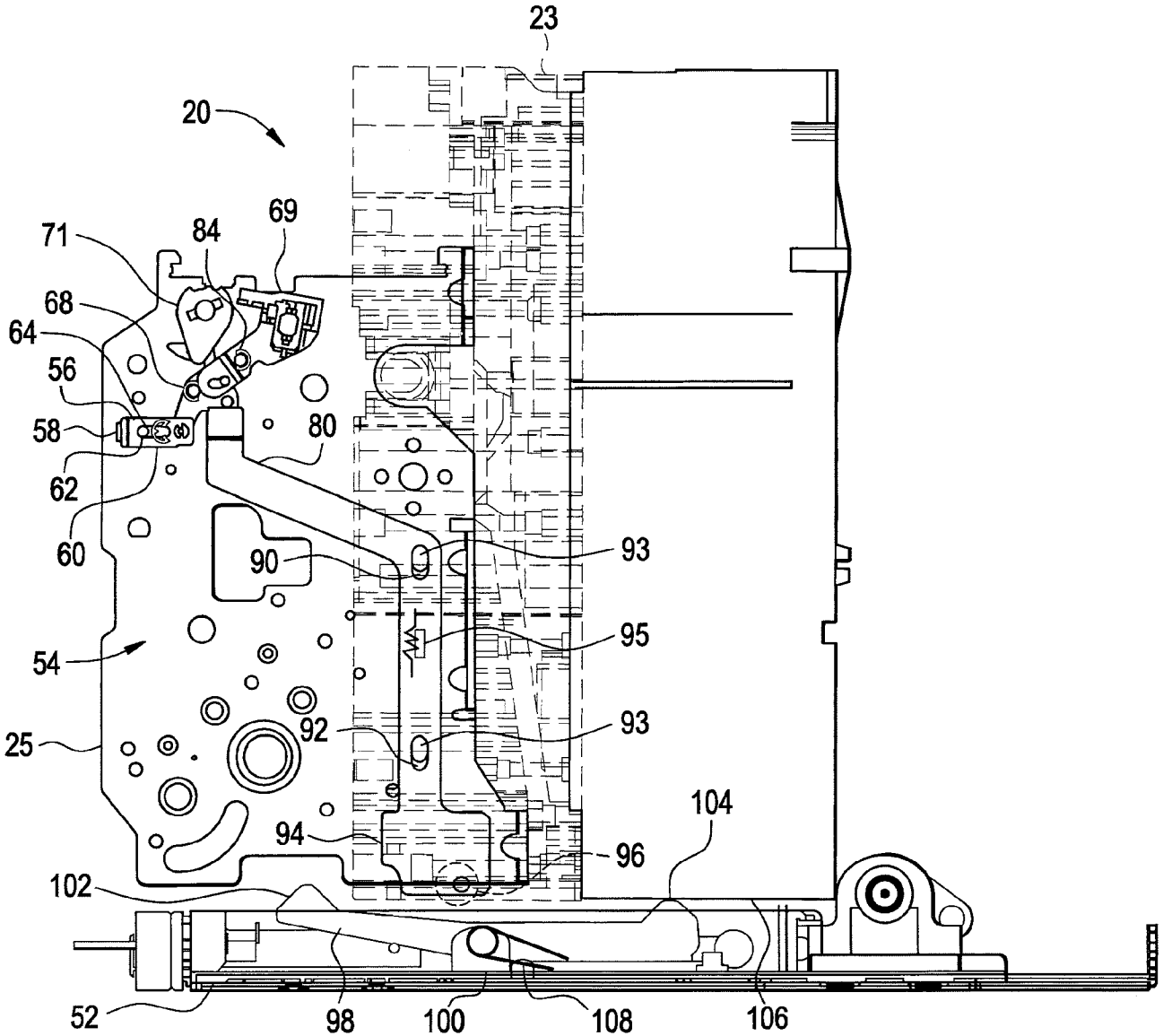
FIG. 3 is a side plan view illustration of the circuit breaker spring discharge mechanism for the circuit breaker of FIG. 1 in the connected position.
Figure 4:
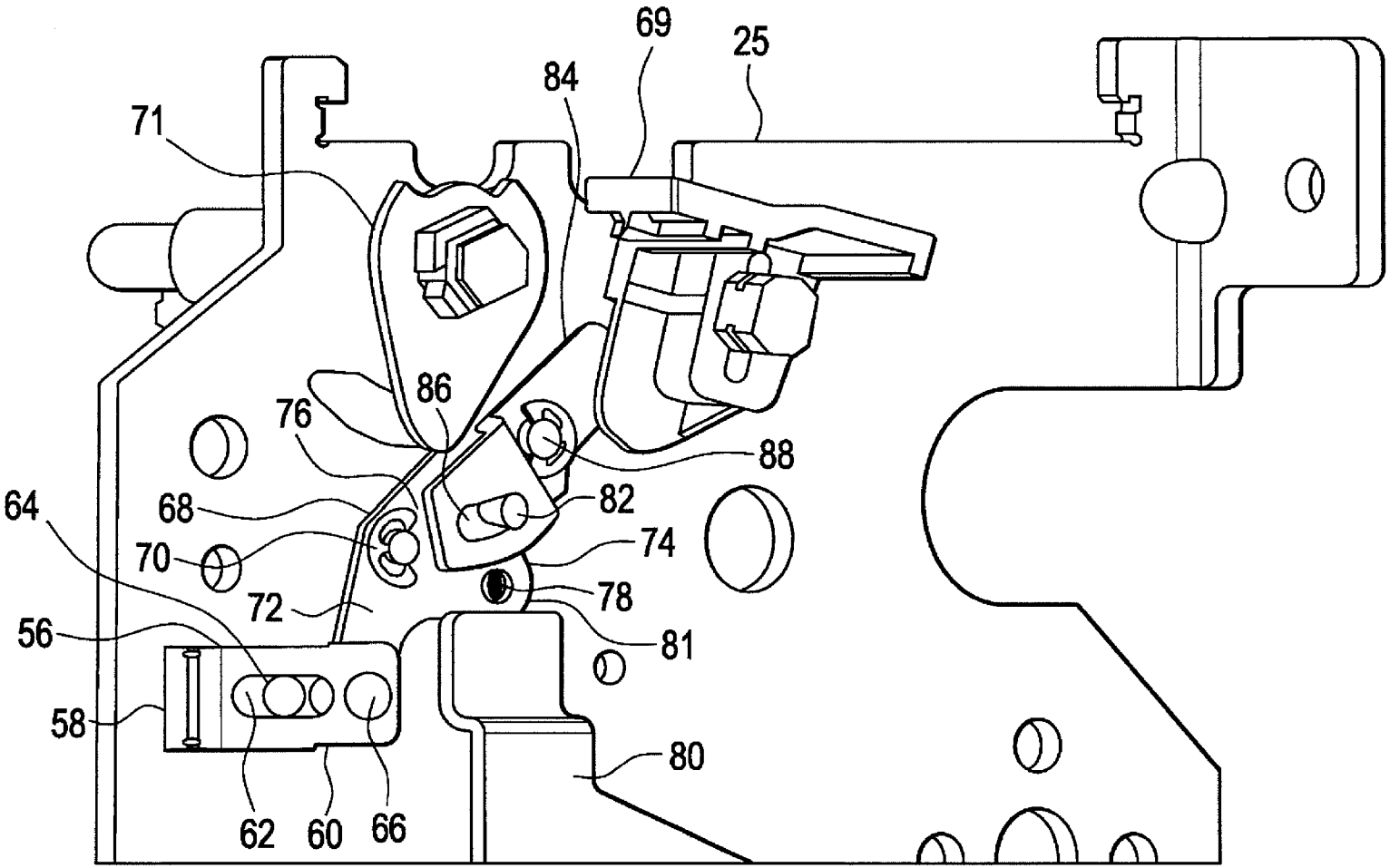
FIG. 4 is a partial side plan view illustration of the spring discharge mechanism of FIG. 3.

In typical Air circuit breakers the main mechanism will have a closing latch shaft assembly 71 that is used to hold the closing latch linkage (not shown) and a opening shaft assembly 69 which holds an opening latch linkage (not shown). Referring to FIG. 3 the rotation of the closing latch shaft assembly 71 in the clockwise direction will cause the release of the closing latch linkage further causing to release the energy stored in the main mechanism spring 27. This energy will be utilized to close the contact system against the contact springs 50 during the normal closing operation. During the normal closing operation the opening shaft assembly 69 will hold the opening latch linkages. Similarly under normal conditions, the rotation of opening shaft assembly in the anti-clockwise direction will cause the opening latch to be unlatched and linkages will collapse to open the circuit breaker contacts by contact springs 50.

Referring now to FIG. 3, a spring discharge mechanism or "crash" mechanism will be described. The circuit breaker 20 may be mounted in several different configurations. The two most common are a "fixed" breaker installation and a drawout installation. In the fixed breaker installation, conductors 40, 44 are mechanically fastened to the protected electrical circuit. In a drawout installation, the circuit breaker 20 is installed on a drawout mechanism 52. The drawout mechanism 52 includes further assemblies that are well known in the art for moving the circuit breaker 20 into and out of connection with the protected electrical circuits. Typically, the drawout mechanism 52 will include mechanical linkages that move the circuit breaker 20 when activated by service or installation personnel.

It is desirable to have the circuit breaker main mechanism springs 27 in the discharged position when maintenance and service operations are being performed. It is further desirable to have the circuit breaker 20 automatically discharge the main mechanism springs 27. This exemplary embodiment deals with two methods by which the main mechanism springs 27 can be discharged. One is a manual mode and other is an automatic mode. The manual mode is used mostly in "fixed" breaker installations. The automatic mode is applicable to only in a drawout installation. An exemplary spring discharge mechanism 54 that includes such features is illustrated in FIG. 3.

The spring discharge mechanism 54 includes a manual activation linkage 56. The linkage 56 includes a flat portion 58 that forms a surface or button for an operator to push. Perpendicular to the flat portion 58 is a body 60 having a slot 62. The slot 62 is sized to fit a pin 64 that slidably couples the linkage 56 to the frame 25. The pin 64 may retain the linkage 56 by any typical means, including a retaining clip, a snap-ring, a rivet or a nut for example. Another pin 66 positioned opposite the flat portion 58 couples the linkage 56 to interface plate 68.

The interface plate 68 is coupled to the frame 25 by a pin 70. The pin 70 may retain the interface plate 68 by any means that allows the interface plate to rotate freely about the pin 70, such as by a snap ring or a rivet for examples. The interface plate 68 has three arms 72, 74 and 76. Each of these arms 72, 74 and 76 couples the interface plate 68 to a linkage that ultimately results in the rotation of a opening latch shaft 69. As will be discussed in more detail below, if the circuit breaker contacts are in the closed position, the rotation of the opening latch shaft 69 will cause the opening of circuit breaker 20. Arm 72 couples to the manual activation linkage 56 as discussed above. Arm 74 includes a pin 78 that provides a contact surface for a surface 81 on cassette interface lever 80 as will be discussed in more detail herein. The third arm 76 includes another pin 82 that couples the interface plate 68 to a trip interface linkage 84.

The trip interface linkage 84 connects the interface plate 68 to the opening latch shaft 69. The trip linkage 84 includes a slot 86 in which the pin 82 is positioned. As will be discussed below, when the interface plate 68 is rotated in the anticlockwise direction, the pin 82 will interface with linkage 84 causing the linkage 84 to rotate in the clockwise direction about the pivot pin 88. The clockwise rotation of the linkage 84 will cause the opening latch shaft 69 to rotate. The interface linkage 84 is also coupled to the frame 25 by a pin 88 and retained by a fastener such as a snap-ring for example.

The movement of interface linkage 84 results in the rotation of the opening latch shaft 69. As discussed above, if the main contacts 34, 42 are closed, the rotation of the opening latch shaft 69 causes the main contacts 34, 42 to open or separate, halting the flow of electrical power to the protected circuit. If the main contacts 34, 42 are already open, the rotation of the opening latch shaft 69 will help to keep the opening latch linkage in unlatched position thus not allowing the main contacts 34, 42 to close. After the rotation of the opening latch shaft 69, the interface plate 68 continues to rotate and engage the closing latch shaft 71. The rotation of the closing latch shaft 71 in the clockwise direction results in the compression springs 27 being discharged as the position of opening shaft 69 is keeping the opening latch linkage in unlatched condition. Therefore, the release of the energy from compression springs 27 will not be utilized to close the main contacts 34, 42 against contact spring 50. The energy released by the compression springs 27 will therefore be dissipated without performing any useful work. This method of discharging the compression springs 27 is sometimes referred to as "crashing" the circuit breaker. Once the main contacts 34, 42 are opened and the compression springs 27 are discharged, the service personnel can disconnect the conductors 40, 44 from the protected electric circuit and remove the circuit breaker 20. It should be appreciated that while the interface plate 68 is rotating the closing shaft 71, the opening latch shaft 69 may be maintained at the unlatched position, or further rotated, provided that the further rotation maintains the unlatched state.

The compression springs 27 may also be automatically discharged in drawout installation. The cassette interface lever 80 extends parallel to the length of the frame 25. The interface lever 80 includes a first slot 90 and a second slot 92. The slots 90 and 92 are captured on a pair of pins 93 that include fasteners (not shown) such as retaining-rings for example. The slots 90, 92 and pins 93 cooperate to retain the interface lever 80 to the frame 25 while allowing the interface lever 80 to move between a first and second position. A frame portion 94 is located on the end of the interface lever 80 opposite contact surface 81. A roller 96 is mounted to the frame portion 94. An extension spring 95 is coupled between the interface lever 80 and the frame 25. The spring 95 biases the interface lever 80 away from the interface plate 68.

When the circuit breaker 20 is installed in a drawout mechanism 52, the roller 96 is positioned adjacent to an interface cam lever 98 mounted to the drawout mechanism 52 as illustrated in FIGS. 3 and 5-7. In this embodiment, the cam lever 98 is coupled to a pivot on standoff 100. The cam lever 98 includes a first cam surface 102 and a second cam surface 104. In the exemplary embodiment, both cam surfaces include a pair of inclined surfaces. The first cam surface 102 is arranged on one side of the standoff 100 adjacent to the roller 96. The second cam surface 104 is arranged opposite the first cam surface 102. The second cam surface 104 is arranged to be in contact with the bottom surface 106 of the housing 23 when the circuit breaker 20 is positioned in connection with the protected electrical circuit. A spring 108 is coupled to the cam lever 98 to bias the second cam surface 104 into the housing bottom surface 106.

Figure 8:
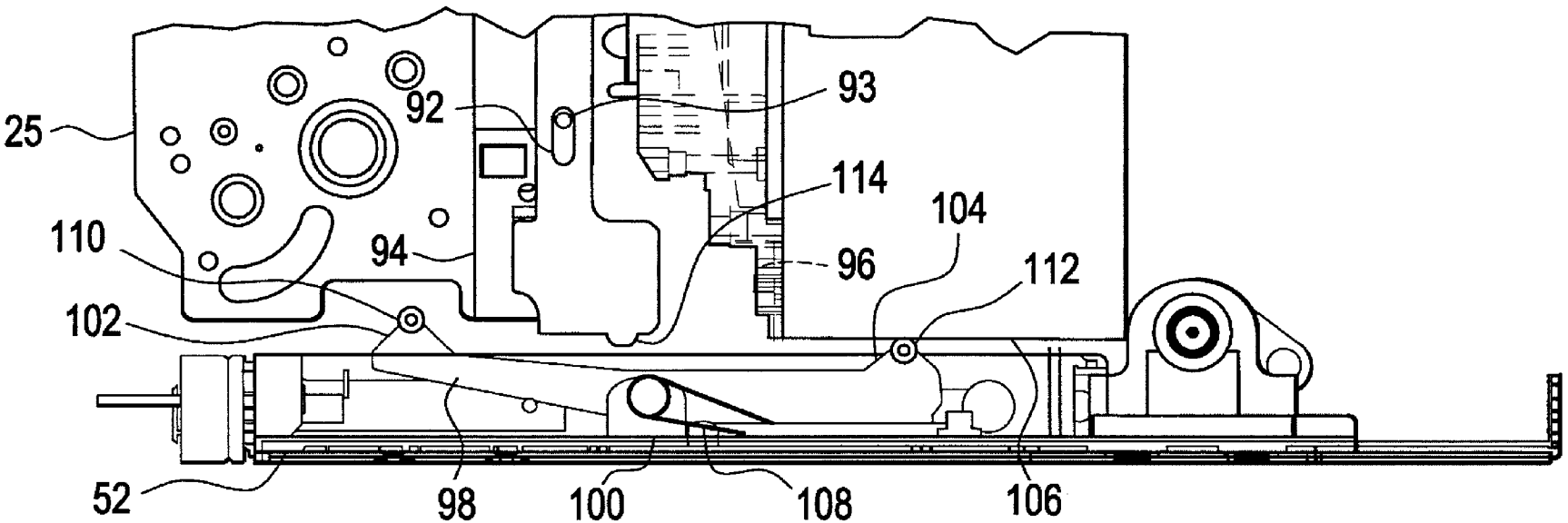

Alternatively, as illustrated in FIG. 8, it is also understood that the cam surfaces 102, 104 may be rollers 110, 112, similar to roller 96 for example, instead of a cam surface. Further, the roller 96 may be a cam surface 114, such as cam surfaces 102, 104 for example, without deviating from the scope of the claimed invention.

Figure 5:
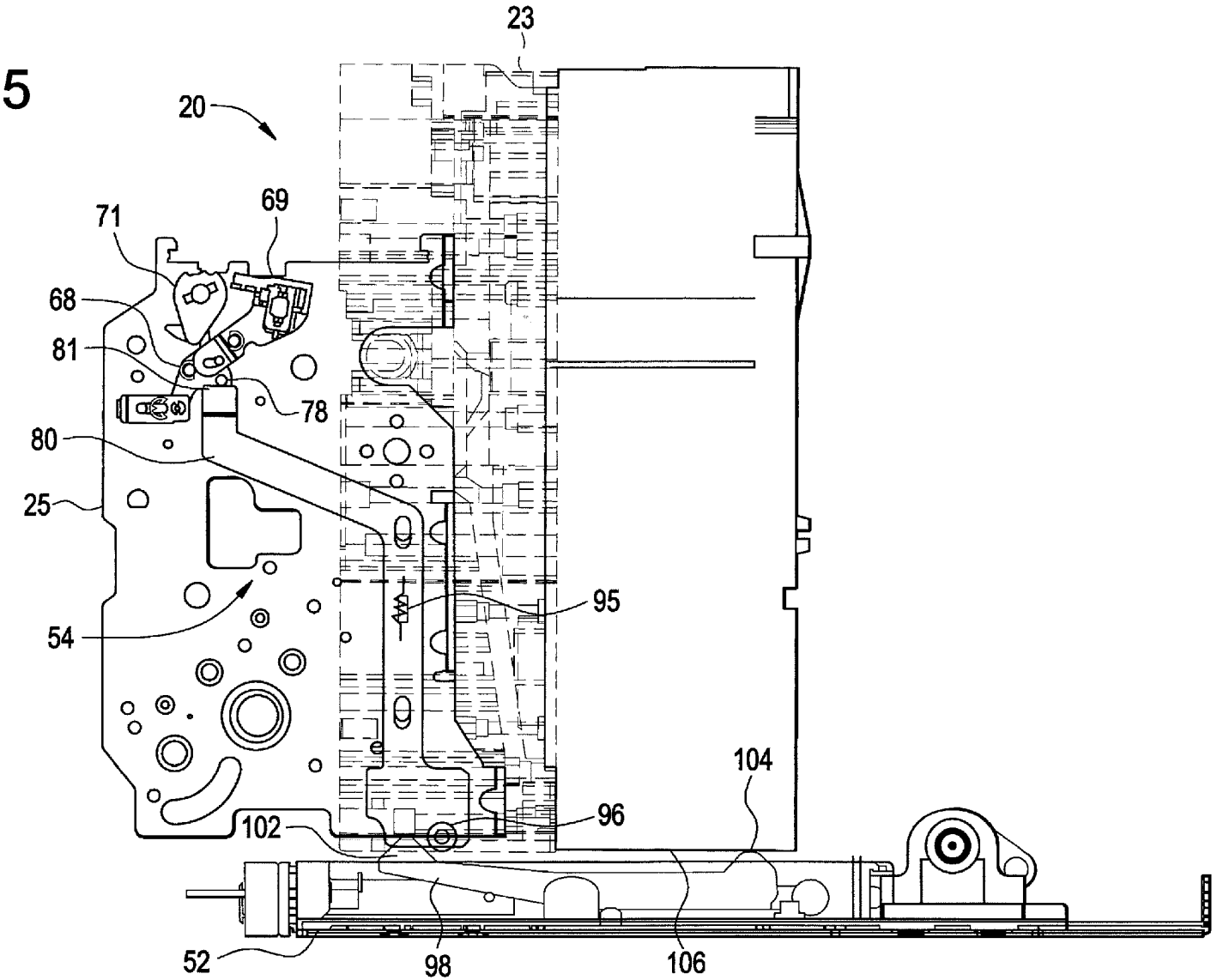
FIG. 5 is a side plan view illustration of the circuit breaker spring discharge mechanism for the circuit breaker of FIG. 1 in the disconnected position.
Figure 6:
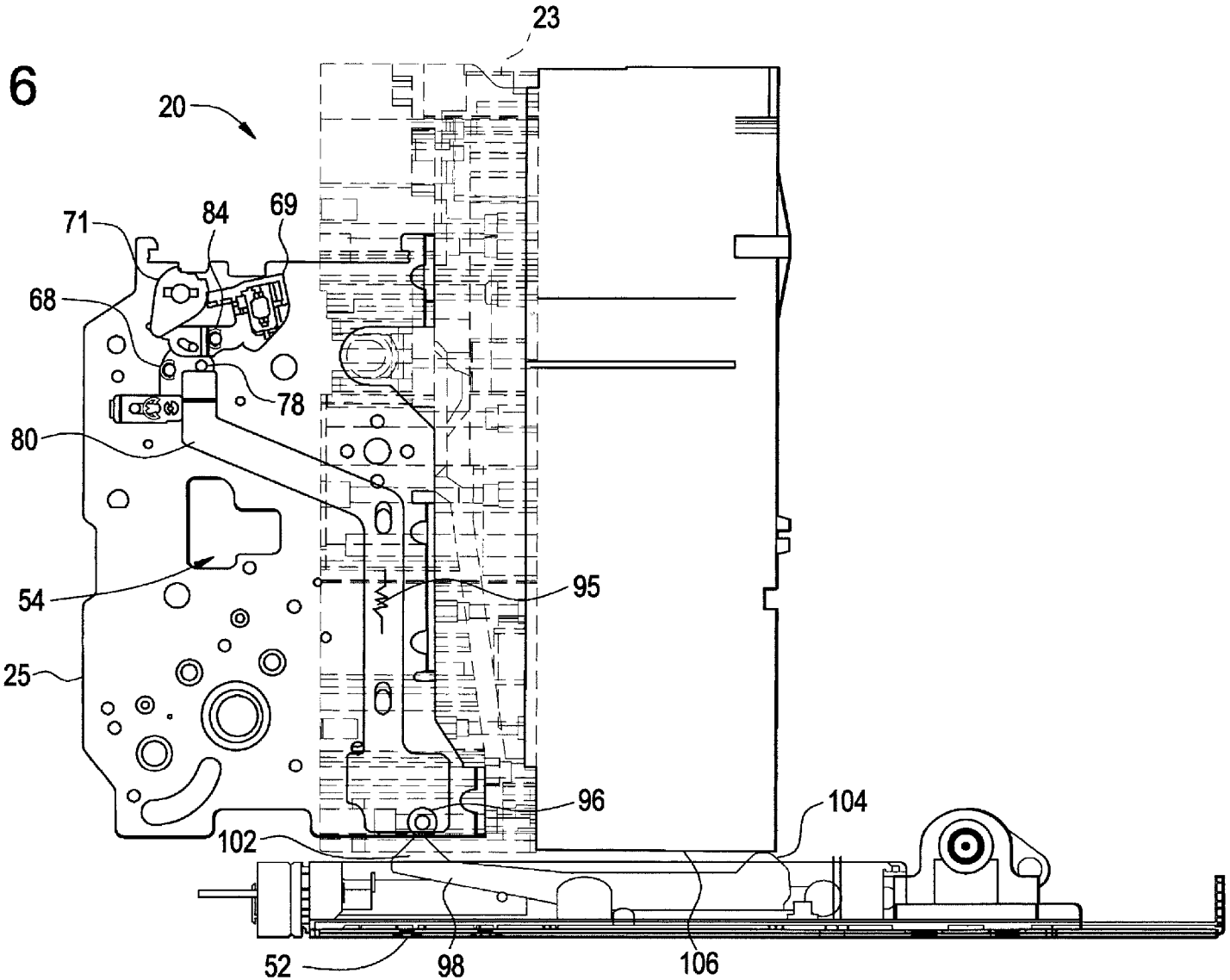
FIG. 6 is a side plan view illustration of the circuit breaker spring discharge mechanism for circuit breaker of FIG. 1 with the spring discharge feature activated.
Figure 7:
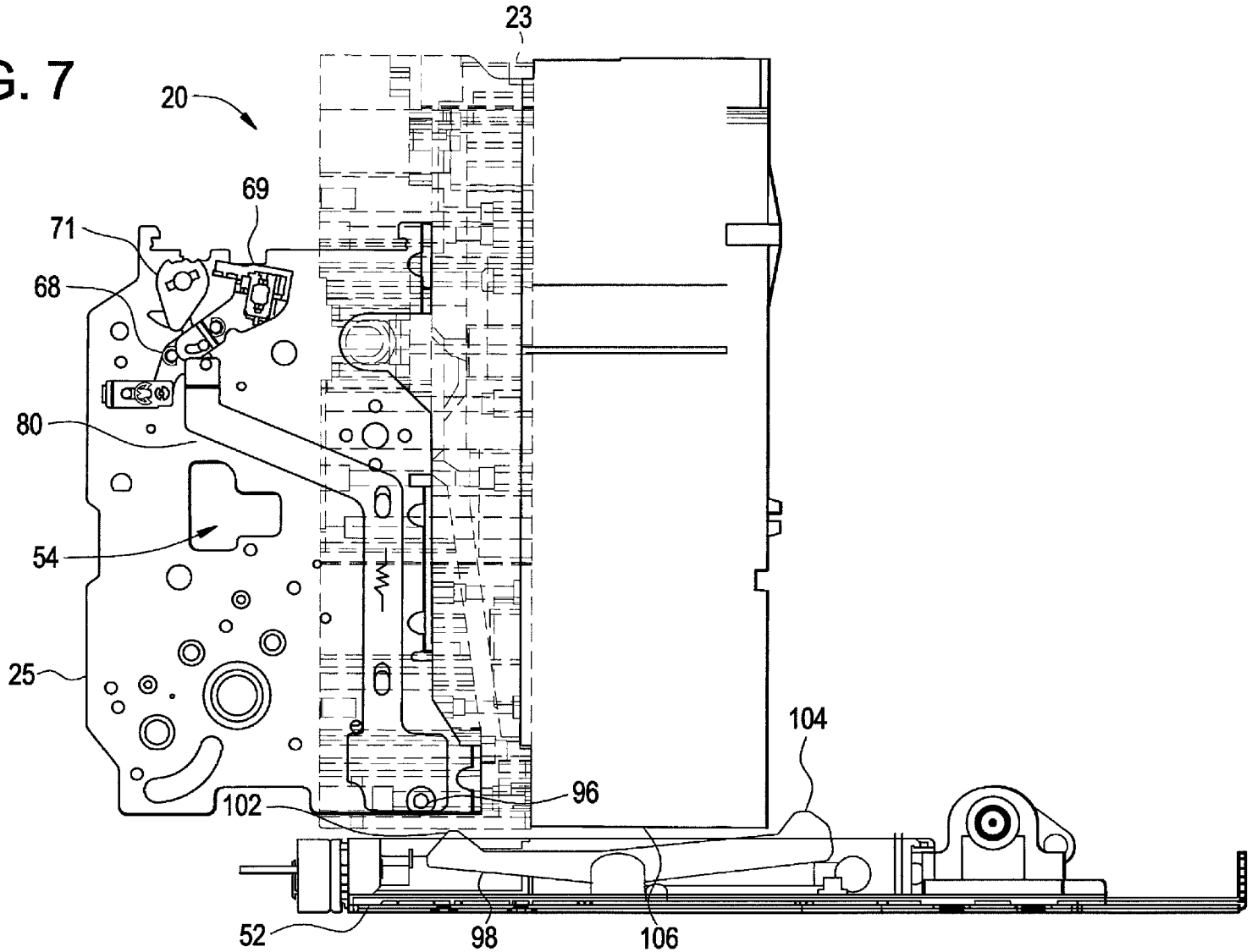
FIG. 7 is a side plan view illustration of the circuit breaker spring discharge mechanism for the circuit breaker of FIG. 1 after the disconnected position; and, FIG. 8 is a partial side plan view illustration of an alternate embodiment drawout cam lever.

In the drawout installation, the circuit breaker 20 is moved from the connected position shown in FIG. 3 to a disconnected position shown in FIGS. 5-7 by drawout mechanism 52. In FIG. 5, the circuit breaker 20 has initiated movement and is disengaged from the protected electric circuit, however, the compression springs 27 could remain charged. In this intermediate position, the first cam surface 102 approaches the roller 96 and the second cam surface 104 remain in contact with the bottom surface 106.

As the circuit breaker 20 continues to move away from the connected position, the first cam surface 102 engages the roller 96. The second cam surface 104 remains in contact with the bottom surface 106 preventing the cam lever 98 from rotating until the circuit breaker 20 reaches a desirable position for example a disconnected position. When the circuit breaker 20 continues to move further beyond this desirable position, the disconnected position for example, the roller 96 will move up the inclined surface of the first cam surface 102 as illustrated in FIG. 6. This movement of the roller 96 causes the surface 81 of interface lever 80 to engage the pin 78 of interface plate 68. Similar to the movements discussed above in relation to the movement of the activation linkage 56, once the interface lever surface 81 contacts the interface plate 68, the interface plate 68 will rotate about pin 70. The rotation of the interface plate 68 in turn moves the trip interface linkage 84 and rotates the opening latch shaft 69. If the main contacts 34, 42 are closed, the rotation of the opening latch shaft 69 will cause the main contacts 34, 42 to open. If the main contacts 34, 42 are already open, then the rotation of the opening latch shaft 69 will keep the opening latch linkages in unlatched position thus not allowing the main contacts 34, 42 to close. Similar to the operation of the activation linkage 56, the interface lever 80 continues to travel or slide past the point where the opening latch shaft 69 rotates. This movement causes the interface plate 68 to engage and rotate the closing latch shaft 71. The rotation of the closing latch shaft 71 discharges or crashes the compression springs 27.

As the drawout mechanism continues to move the circuit breaker 20 away from the protected circuit, the roller 96 continues down the opposite inclined portion of the first cam surface 102. Under the bias of the spring 95, the interface lever 80 reverses direction and the surface 81 slides away from pin 78. Just prior to the circuit breaker 20 reaching the fully withdrawn position, the second cam surface 104 moves past the edge of the bottom surface 106 allowing the cam lever 98 to rotate under the bias of spring 108 as illustrated in FIG. 7. The rotation of the cam lever 98 results in the rotation of first cam surface 102 away from the roller 96. In the fully disconnected position, the second cam surface 104 is positioned above the bottom surface 106.

Once the drawout mechanism 52 has reached the fully withdrawn position shown in FIG. 7, the service personnel may perform any repairs or maintenance operations. Such maintenance operations may include replacement of the main contacts 34 and 42, or lubrication of the circuit breaker mechanisms for example. Once the repair or replacement has been performed, the service personnel operate the drawout mechanism 52 once again. This reverses the motion of the circuit breaker 20 towards the connected position shown in FIG. 3.

As the circuit breaker 20 moves, the second cam surface 104 engages the edge of housing bottom surface 106. As the edge of the bottom surface 106 moves along the inclined surface of second cam 104, the cam lever 98 rotates causing the first cam surface 102 to move towards roller 96. Similar to that described above, the roller 96 will move up the inclined surface of first cam surface 102, causing the interface lever 80 and the surface 81 towards and into engagement with the interface plate 68. As discussed above, the rotation of the interface plate 68 causes the discharge of energy in the compression springs 27 if it is charged. Thus, if the service personnel left the circuit breaker 20 in the closed position, or with the compression springs 27 charged, after performing their repairs or maintenance, the movement of the circuit breaker 20 by drawout mechanism 52 will result in the crashing or opening of the main contacts 34, 42. It should be appreciated that it is desirable to have the main contacts 34, 42 open when the circuit breaker 20 re-connects to the protected electric circuit to prevent inadvertent or premature energizing of the protected electric circuit.

It should be appreciated that the spring discharge mechanism 54 provides a number of advantages to service personnel and in the manufacture of the circuit breaker 20. The spring discharge mechanism 54 allows the manufacturer to use the same circuit breaker in both a fixed breaker installation and a drawout installation resulting in lower costs. The spring discharge mechanism 54 also allows the installation personnel to have lower operating costs since they only need to stock or purchase one type of circuit breaker for the aforementioned installation types. The spring discharge mechanism 54 further provides advantages in automatically opening the circuit breaker contacts in the event the circuit breaker is removed from a drawout installation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a circuit breaker, said method comprising:

rotating an interface plate from a first position to a second position;

rotating an opening latch shaft from a third position to a fourth position with said interface plate;

opening a set of contacts when said opening latch shaft is in said fourth position;

rotating said interface plate from said second position to a fifth position;

rotating a closing latch shaft from a sixth position to a seventh position when said interface plate rotates from said second position to said fifth position; and, discharging energy stored in compression springs when said closing latch shaft rotates from said sixth position to said seventh position.

2. The method of claim 1 further comprising the steps of:

biasing a cam lever first surface into contact with a circuit breaker housing bottom surface;

moving said circuit breaker housing from an eighth position in contact with an electrical load to a ninth position;

contacting a second surface of said cam lever with a roller when said housing reaches said ninth position; and sliding an interface lever from a tenth position to an eleventh position in response to said cam lever second surface contacting said roller.

3. The method of claim 2 further comprising the step of contacting said interface plate with said interface lever.

4. The method of claim 3 wherein said sliding of said interface lever rotates said interface plate from said first position to said fifth position via an intermediate twelfth position.

5. The method of claim 1 further comprising the step of sliding a manual activation linkage from a twelfth position to a thirteen position.

6. The method of claim 5 wherein said sliding of said manual activation linkage rotates said interface plate from said first position to said fifth position via an intermediate twelfth position.

7. A method of operating a circuit breaker drawout, said method comprising:

biasing a cam lever first surface into contact with a circuit breaker housing bottom surface;

moving said circuit breaker housing from a first position in contact with an electrical load to a second position;

contacting a second surface of said cam lever with a roller when said housing reaches said second position;

sliding an interface lever from a third position to a fourth position in response to said cam lever second surface contacting said roller;

rotating an interface plate from a fifth position to a sixth position in response to said interface lever moving from said third position to said fourth position;

rotating an opening latch shaft when said interface plate rotating from said fifth position to said sixth position;

rotating said interface plate from said sixth position to a seventh position; and, rotating a closing latch shaft in response to said rotation of said interface plate from said sixth position to said seventh position.

8. The method of claim 7 further comprising the step of opening a set of contacts in response to said rotation of said opening latch shaft.

9. The method of claim 8 further comprising the step of discharging compression springs in response to said rotation of said closing latch shaft.

10. The method of claim 9 further comprising the steps of:

moving said housing to an eighth position wherein said circuit breaker is withdrawn from service;

rotating said cam lever when said housing reaches said eighth position.

11. The method of claim 10 further comprising the step of disconnecting said circuit breaker from a protected circuit at or before said housing reaches said second position.

12. A circuit breaker comprising:

a contact structure movable between a closed and an open position;

a compression spring operable between a charged and a discharged position, said compression spring operably coupled to said contact structure;

an opening latch shaft operably coupled to said contact structure;

a closing latch shaft operably coupled to said compression spring; and a first mechanism including:

an interface plate pivotable between a first position and a third position via an intermediate second position, said interface plate operably coupled to rotate said opening latch shaft and said closing latch shaft, wherein said closing latch shaft is rotated when said interface plate is moved between said first position and said intermediate second position, and said opening latch shaft is rotated when said interface plate is moved between said intermediate second position to said third position;

an interface lever slidable between a fourth position and a fifth position, said interface lever having a first surface operably coupled to rotate said interface plate.

13. The circuit breaker of claim 12 further comprising a manual activation linkage coupled to rotate said interface plate.

14. The circuit breaker of claim 13 further comprising a trip interface linkage coupled between said interface plate and said opening latch shaft.

15. The circuit breaker of claim 14 further comprising a first roller coupled for rotation to said interface lever.

16. The circuit breaker of claim 15 wherein said manual activation linkage is slidable between a sixth position and a seventh position and wherein said compression spring moves from said charged position to said discharged position when said manual activation linkage is moved from said sixth position to said seventh position while holding said contact structure in said open position.

17. The circuit breaker of claim 15 wherein said compression spring moves from said charged position to said discharged position when said interface lever is moved from said third position to said fourth position while holding said contact structure in said open position.

18. The circuit breaker of claim 15 further comprising a drawout mechanism, said drawout mechanism comprising a lever having a first and second end, said lever being pivotable about a middle portion, said lever first end including a first cam surface arranged to engage said first roller, said lever second end including a second cam surface arranged to engage a circuit breaker housing.

19. The circuit breaker of claim 15 further comprising a drawout mechanism, said drawout mechanism comprising a lever having a first and second end, said lever being pivotable about a middle portion; said lever second end including a second roller arranged to engage a circuit breaker housing.

20. The circuit breaker of claim 14 further comprising a cam surface coupled to said interface lever opposite said interface plate.

* * * * *

UNITED STATES PATENT AND TRADEMARK OFFICE

CERTIFICATE OF CORRECTION

PATENT NO. : 7,863,534 B2
APPLICATION NO. : 12/103075
DATED : January 4, 2011
INVENTOR(S) : Narayanasamy et al.

It is certified that error appears in the above-identified patent and that said Letters Patent is hereby corrected as shown below:

On the Title Page, in Field (75), under "Inventors", in Column 1, Line 3, delete "Andra" and insert -- Andhra --, therefor.

In Column 1, Line 17, delete "tows" and insert -- to as --, therefor.

In Column 8, Line 11, in Claim 5, delete "thirteen" and insert -- thirteenth --, therefor.

Signed and Sealed this
Twenty-fourth Day of May, 2011

David J. Kappos

David J. Kappos
*Director of the United States Patent and Trademark Office*